US009865965B2

(12) United States Patent
Enomoto et al.

(10) Patent No.: US 9,865,965 B2
(45) Date of Patent: Jan. 9, 2018

(54) WATERPROOF STRUCTURE FOR TERMINAL OF WIRE WITH TERMINAL FITTING

(71) Applicant: SUMITOMO WIRING SYSTEMS, LTD., Mie (JP)

(72) Inventors: Keisuke Enomoto, Mie (JP); Kenichi Inokoshi, Mie (JP); Atsushi Ishikawa, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 15/532,328

(22) PCT Filed: Dec. 2, 2015

(86) PCT No.: PCT/JP2015/083871
§ 371 (c)(1),
(2) Date: Jun. 1, 2017

(87) PCT Pub. No.: WO2016/093123
PCT Pub. Date: Jun. 16, 2016

(65) Prior Publication Data

US 2017/0271811 A1 Sep. 21, 2017

(30) Foreign Application Priority Data

Dec. 11, 2014 (JP) ..... 2014-250872

(51) Int. Cl.
*H01R 13/514* (2006.01)
*H01R 13/56* (2006.01)
(Continued)

(52) U.S. Cl.
CPC ..... *H01R 13/56* (2013.01); *H01R 13/516* (2013.01); *H01R 13/5216* (2013.01)

(58) Field of Classification Search
CPC .. H01R 13/6272; H01R 4/2433; H01R 13/58; H01R 13/562; H01R 103/00
(Continued)

(56) References Cited

U.S. PATENT DOCUMENTS 7,927,151 B2 * 4/2011 Prest ..... H01R 13/035 439/669
8,235,756 B2 * 8/2012 Stiehl ..... H01R 24/58 439/669
(Continued)

FOREIGN PATENT DOCUMENTS

JP 05-129062 5/1993
JP 2002-127188 5/2002
(Continued)

OTHER PUBLICATIONS

Search Report issued in International Bureau of WIPO Patent Application No. PCT/JP2015/083871, dated Mar. 8, 2016.

*Primary Examiner* — Phuong Chi T Nguyen
(74) *Attorney, Agent, or Firm* — Greenblum & Bernstein, P.L.C.

(57) ABSTRACT

The present invention provides a waterproof structure for a terminal of a wire with a terminal fitting provided with a waterproof block made of resin, the waterproof block covering an end portion of an insulation coated wire which is coupled to a terminal fitting. The waterproof block includes a waterproof portion covering a coupling portion coupling the end portion of the wire and the terminal fitting, the waterproof portion adhering to an outer circumferential surface of an end of an outer skin of the wire, and a cylindrical portion projecting cylindrically from the waterproof portion along the outer skin of the wire. The cylindrical portion has a smaller cross sectional area than the waterproof portion and has rigidity more similar to the outer skin than the waterproof portion in desired bending and
(Continued)

torsional directions of the wire and is adhered to an end-adjacent outer circumferential surface of the outer skin.

5 Claims, 8 Drawing Sheets

(51) Int. Cl.
*H01R 13/52* (2006.01)
*H01R 13/516* (2006.01)

(58) Field of Classification Search
USPC ..... 439/731, 687, 447, 352, 417, 449
See application file for complete search history.

(56) References Cited

U.S. PATENT DOCUMENTS 8,333,618 B2 * 12/2012 Prest ..... H01R 13/035 439/669
2011/0021084 A1 * 1/2011 Crooijmans ..... H01R 24/58 439/668

FOREIGN PATENT DOCUMENTS

JP 2008-258103 10/2008
JP 2011-018582 1/2011

* cited by examiner

WATERPROOF STRUCTURE FOR TERMINAL OF WIRE WITH TERMINAL FITTING

FIELD OF THE INVENTION

The present invention relates to a waterproof structure for a terminal of a wire with a terminal fitting, and particularly relates to a waterproof structure for a terminal of a wire with a terminal fitting having a waterproof block made of resin provided to a terminal portion where the terminal is mounted.

BACKGROUND OF THE INVENTION

Ground wires and the like which are mounted in a vehicle may include a waterproof structure for a terminal of a wire with a terminal fitting provided with a waterproof block made of resin, the waterproof block covering an end portion of an insulation coated wire coupled to a terminal fitting for electric connection and sealing out water (waterproofing an interior of the wire).

A known example of such a waterproof structure for a terminal of a wire with a terminal fitting is, for example, a waterproof structure for a terminal of a wire with a terminal fitting in which an exposed end portion of a conductor having an end portion coated by an outer skin of an insulation coated wire peeled away, and an adjacent insulation resin portion surrounded by the outer skin are crimped to the terminal fitting having a crimping portion for each and a waterproof block made of resin is injection molded to surround the crimped portions (see Patent Literature 1, for example).

In this example, the end portion on the wire side of the waterproof block has a tapered shape, gradually reducing in diameter from the insulation resin crimping portion of the terminal fitting toward an area around the outer skin of the wire.

RELATED ART

Patent Literature

Patent Literature 1: Japanese Patent Laid-open Publication No. 2002-127188

SUMMARY OF THE INVENTION

Problems to be Solved by the Invention

However, in the conventional waterproof structure for the terminal of the wire with the terminal fitting described above, when the wire such as a thick ground wire has high rigidity against bending and torsion and a curvature radius of the wire becomes large, during bending and torsion of the wire, stress concentrates on an inner circumferential edge of the end portion of the waterproof block and at a portion of the outer skin of the insulation coated wire bonded thereto, and the outer skin of the insulation coated wire is likely to peel at the inner circumferential edge of the end portion of the waterproof block. Therefore, for example, grounding of the ground wire cannot be performed in a wet area such as an engine compartment of a vehicle, so the ground wire must be pulled toward the vehicle interior to perform the grounding. This involves an increase in cost and weight due to the increased wire length.

In addition, when the waterproof block material is hard, a favorable waterproofing performance is obtained at a portion where the shape is stable such as between the conductor crimping portion of the terminal fitting and the insulation resin crimping portion. However, because of the low flexibility of the tapered shape portion, when the outer skin of the insulation coated wire is peeled away at the inner circumferential edge of the end portion, the peeling tends to advance to a deep interior of the waterproof block. Accordingly, in order to ensure the necessary waterproofing performance, a length of the tapered shape portion increases.

On the other hand, when the material of the waterproof block is soft, even at the portion where the shape is stable, such as between the conductor crimping portion of the terminal fitting and the insulation resin crimping portion, the waterproof block is easily deformed and damaged, so the waterproofing performance may drop in a harsh operating environment.

In order to resolve the conventional circumstances mentioned above, the present invention provides a waterproof structure for a terminal of a wire with a terminal fitting capable of ensuring adhesion between and an ability of a wire side end portion of a waterproof block to follow a wire, and of ensuring a stable waterproofing performance of the waterproof portion, which covers a coupling portion coupling the terminal fitting and an insulation coated wire.

Means for Solving the Problems

To resolve the above, the present invention provides a waterproof structure for a terminal of a wire with a terminal fitting provided with a waterproof block made of resin, the waterproof block covering an end portion of an insulation coated wire coupled to a terminal fitting for electrical connection. The waterproof block includes a waterproof portion covering the coupling portion where the terminal fitting and the end portion of the insulation coated wire are coupled, the waterproof portion adhering to an outer circumferential surface of an end of an outer skin of the insulation coated wire, and a cylindrical portion projecting cylindrically from the waterproof portion along the outer skin of the insulation coated wire. The cylindrical portion has a smaller cross sectional area than the waterproof portion and has rigidity more similar to the outer skin than the waterproof portion in desired bending and torsional directions of the insulation coated wire, and is adhered to an adjacent outer circumferential surface which is adjacent to the outer circumferential surface of the end of the outer skin.

With this configuration, compared to a case with a simple tapered shape, in the present invention, the cylindrical portion of the waterproof block has low rigidity in the bending and torsional directions of the insulation coated wire relative to the waterproof portion and easily follows the outer skin. The outer skin deformation caused by the bending and torsion of the insulation coated wire is dispersed in a range of a surface adhering with the cylindrical portion and dose not concentrate at an inner circumferential edge of the end portion of the waterproof block. Therefore, the outer skin of the insulation coated wire is unlikely to peel off at the inner circumferential edge of the end portion of the waterproof block and the peeling becomes unlikely to advance to a deep interior from the inner circumferential edge of the end portion of the waterproof block. In addition, at the waterproof portion side of the waterproof block covering the coupling portion coupling the terminal fitting and the wire, a resin capable of obtaining a favorable waterproofing performance, wear resistance, weather resistance, and the like can be used. As a result, the waterproof structure for the terminal of the wire with the terminal fitting can ensure adhesion between and an ability of the wire side end portion of the waterproof block to follow the wire, and ensure the stable waterproofing performance of the waterproof portion covering the coupling portion coupling the terminal fitting and the insulation coated wire.

In the waterproof structure for the terminal of the wire with the terminal fitting according to the present invention, an outer circumferential surface of the cylindrical portion, preferably, includes a stepped contracted portion positioned toward an inner side around a whole circumference relative to a truncated conical surface which extends from an edge of an outer circumferential surface of the waterproof portion on a base end of the cylindrical portion to an edge of the outer circumferential surface of the cylindrical portion at a forefront end of the cylindrical portion.

In this case, by appropriately selecting an axis direction position of the stepped contracted portion on the cylindrical portion, the progress of the peeling toward the waterproof portion of the waterproof block can be suppressed more effectively and the adhesion between and ability of the cylindrical portion to follow the wire can be further enhanced.

In the waterproof structure for the terminal of the wire with the terminal fitting according to the present invention, the outer circumferential surface of the cylindrical portion may include a first stepped contracted portion positioned toward the inner side relative to the truncated conical surface, and a second stepped contracted portion positioned further toward the forefront end of the cylindrical portion than the first stepped contracted portion.

In this way, multi-stage bending and torsion of the cylindrical portion are possible, and therefore, the progress of the peeling toward the waterproof portion of the waterproof block can be suppressed more effectively and the adhesion between and ability of the cylindrical portion to follow the wire can be further enhanced.

The present invention is capable of providing the waterproof structure for the terminal of the wire with the terminal fitting capable of ensuring the adhesion between and ability of the wire side end portion of the waterproof block to follow the wire, and of ensuring the stable waterproofing performance of the waterproof portion, which covers the coupling portion coupling the terminal fitting and the insulation coated wire and seals out water.

MODE FOR CARRYING OUT THE INVENTION

Hereafter, embodiments of the present invention are described with reference to the drawings.

Embodiment 1

FIGS. 1 to 4 illustrate Embodiment 1 of a waterproof structure for a terminal of a wire with a terminal fitting according to the present invention. This embodiment is an example in which the present invention is applied to a wire harness including a wire with a terminal fitting for a ground wire mounted in a vehicle.

A configuration of the present embodiment is described.

The wire harness in the present embodiment is configured by including a wire with a terminal fitting 10 illustrated in FIGS. 1 to 4.

Figure 1:
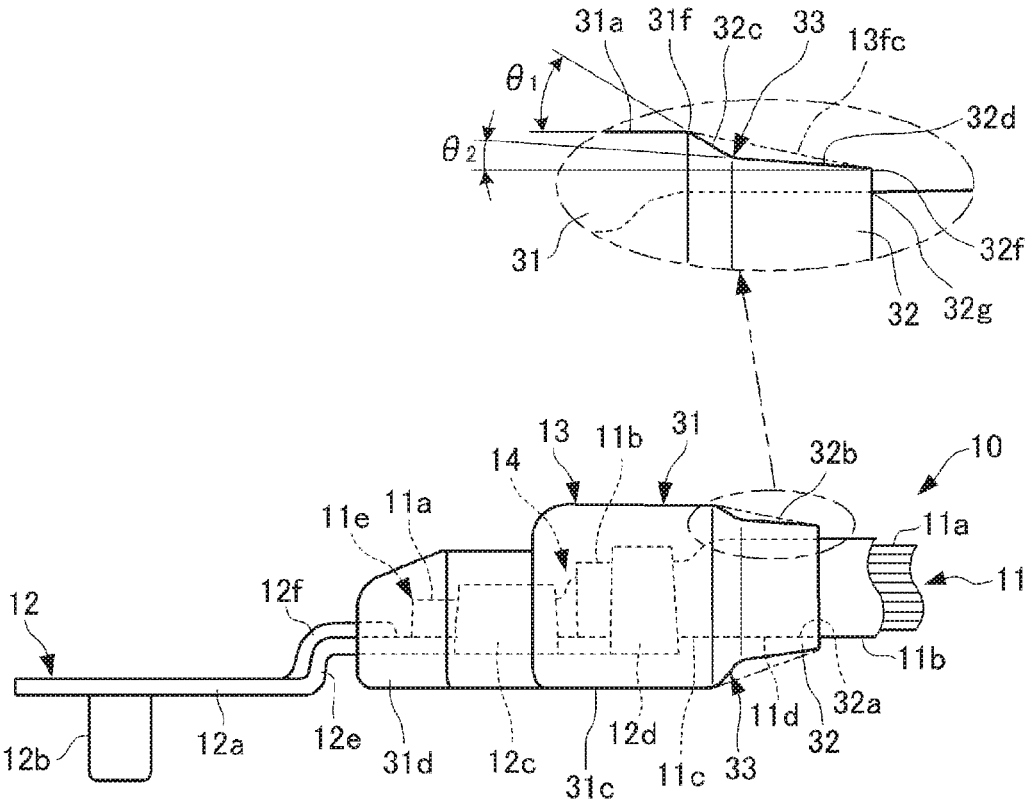
FIG. 1 is a front view of a main portion illustrating Embodiment 1 of a waterproof structure for a terminal of a wire with a terminal fitting according to the present invention.

As shown in FIG. 1, the wire with the terminal fitting 10 is configured by including a wire 11, a terminal fitting 12 crimped to a first end of the wire 11, for example, and a waterproof block 13 made of resin and coating a first end portion 11*e* of the wire 11 coupled to the terminal fitting 12.

The wire 11 is an insulation coated wire which includes a core wire portion 11*a* of a soft copper twisted wire or the like configured with a plurality of conductor element wires, and an outer skin 11*b* made of an insulating resin such as chloroethylene coating the core wire portion 11*a* over substantially an entire length-direction area.

The wire 11 is a thick wire with a relatively large diameter (among wires used as ground wires mounted in the vehicle) having a cross sectional area of the core wire portion 11*a* of at least 5 $mm^2$. For example, a wire with a cross sectional area of about 8 $mm^2$ has higher bending rigidity compared with a thin wire having a cross sectional area of the core wire portion 11*a* of about 2 to 3 $mm^2$.

The first end portion 11*e* of the wire 11 is exposed so as to project the core wire portion 11*a* by a predetermined exposed length from the end portion of the outer skin 11*b*. A second end portion of the wire 11 (not illustrated in the drawings) is connected to, for example, a control device or an auxiliary device of an engine (a portion of electrical equipment for the vehicle).

As shown in FIGS. 2A to 3B, the terminal fitting 12 is a pressed, plate-like terminal made of a metal plate having good conductivity, and may be a round plate terminal, for example. The terminal fitting 12 includes, toward a forefront end thereof, an annular disc-shaped connection portion 12*a* and a projection 12*b* for preventing rotation stop and incorrect assembly.

Figure 2A:
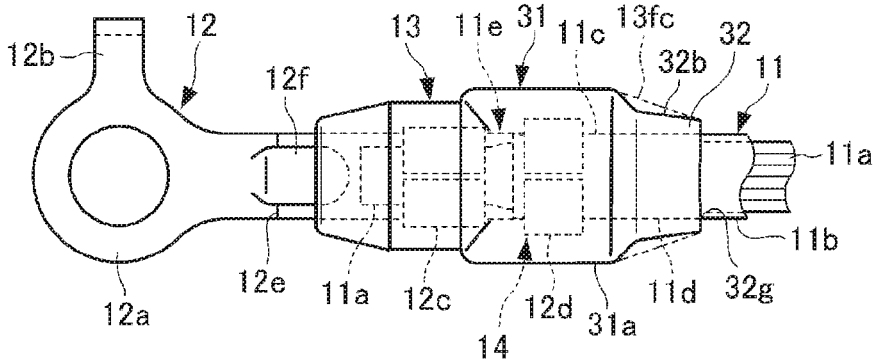
FIG. 2A is a plan view of the main portion illustrating Embodiment 1 of the waterproof structure for the terminal of the wire with the terminal fitting according to the present invention.
Figure 2B:
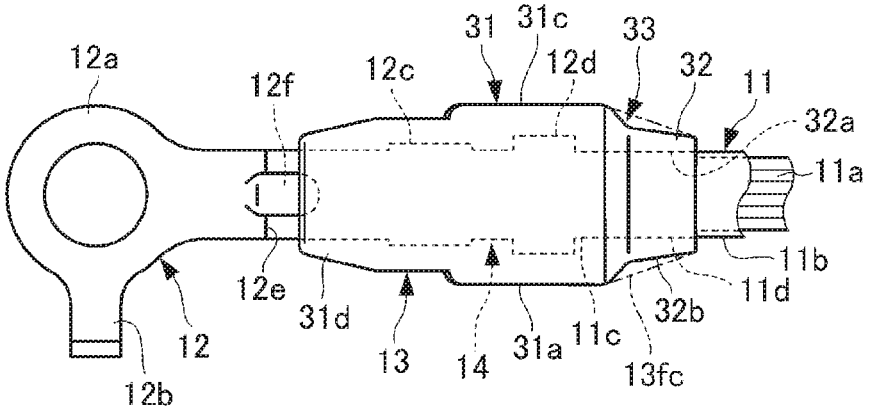
FIG. 2B is a bottom view of the main portion illustrating Embodiment 1 of the waterproof structure for the terminal of the wire with the terminal fitting according to the present invention.
Figure 4:
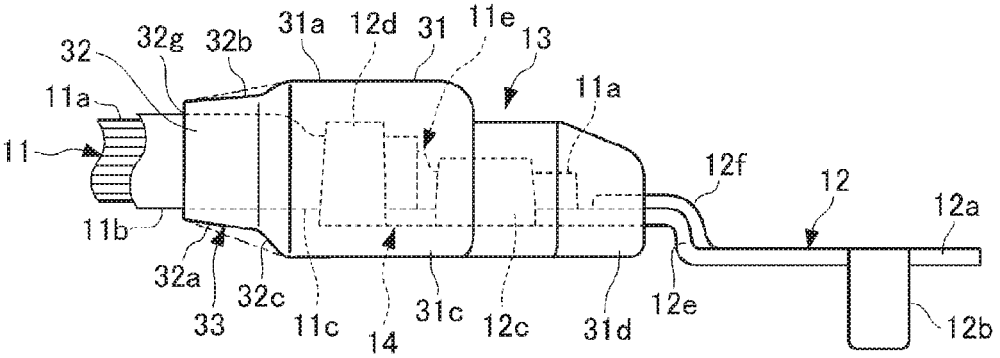
FIG. 4 is a rear view of the main portion illustrating Embodiment 1 of the waterproof structure for the terminal of the wire with the terminal fitting according to the present invention.
Figure 5A:
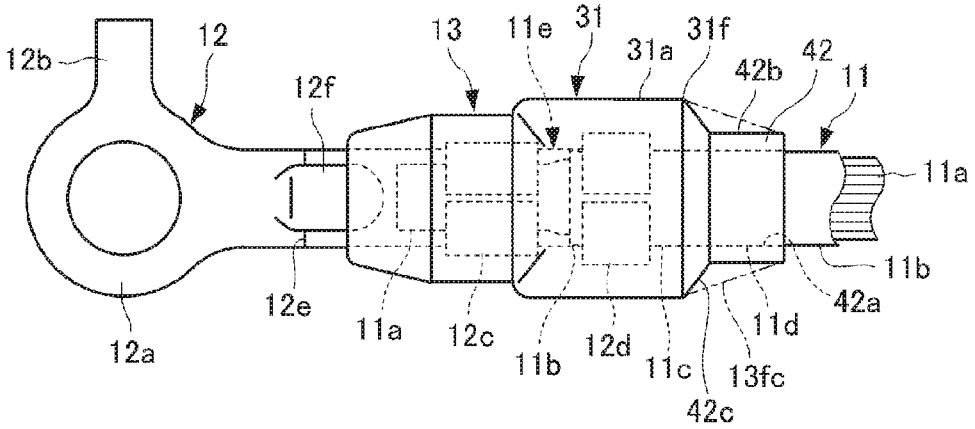
FIG. 5A is a plan view of a main portion illustrating Embodiment 2 of a waterproof structure for a terminal of a wire with a terminal fitting according to the present invention.
Figure 5B:
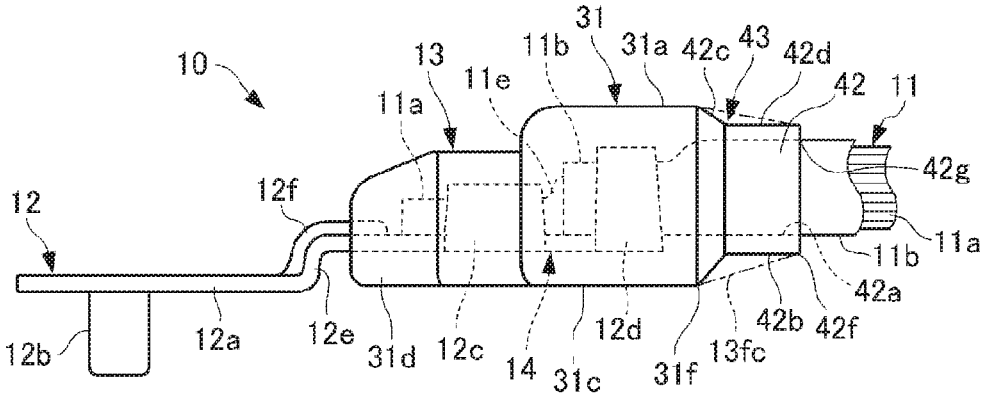
FIG. 5B is a front view of the main portion illustrating Embodiment 2 of the waterproof structure for the terminal of the wire with the terminal fitting according to the present invention.
Figure 6A:
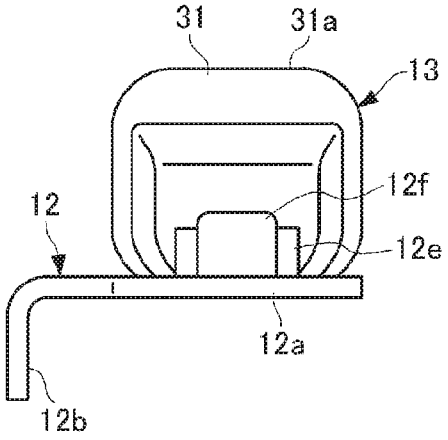
FIG. 6A is a left side view, observed from the left side of FIG. 5B, of Embodiment 2 of the waterproof structure for the terminal of the wire with the terminal fitting according to the present invention.
Figure 6B:
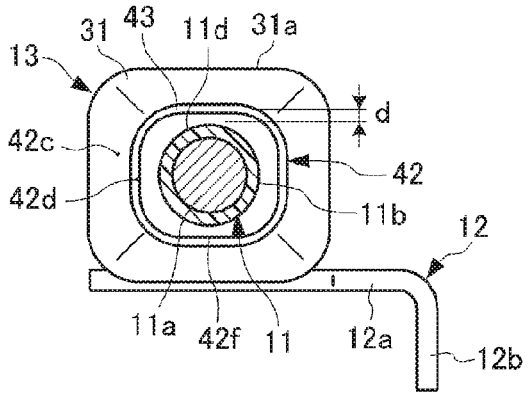
FIG. 6B is a right side view, observed from the right side of FIG. 5B, of Embodiment 2 of the waterproof structure for the terminal of the wire with the terminal fitting according to the present invention.

Further, as shown in FIGS. 1, 2A, and 4, the terminal fitting 12 includes, on a base end where the terminal fitting 12 is coupled to the wire 11, a wire barrel portion 12*c* swaged so as to be crimped to the core wire portion 11*a* of the wire 11 and an insulating resin barrel portion 12*d* swaged so as to be crimped to the outer skin 11*b* of the wire 11.

The core wire portion 11*a* and the outer skin 11*b* of the wire 11, as well as the wire barrel portion 12*c* and the insulating resin barrel portion 12*d* of the terminal fitting 12 configure a coupling portion 14 between the terminal fitting 12 and the first end portion 11*e* of the wire 11.

In the terminal fitting 12, the connection portion 12*a* is bolt-fastened to a ground connection portion on a vehicle body side (not shown in the drawings) of the vehicle. For example, the terminal fitting 12 is configured such that the connection portion 12*a* is bolt-fastened to a ground connection portion inside the engine compartment and grounded.

Furthermore, the terminal fitting 12 includes, between the connection portion 12*a* on the forefront end and the wire barrel portion 12*c* inside the waterproof block 13, a stepped bending portion 12*e* which is worked to be bent in a step and a rib-shaped projecting bent portion 12*f* reinforcing the stepped bending portion 12*e*.

The waterproof block 13 is formed with a water sealant resin which is cured in a state where the resin permeates into gaps between element wires of the core wire portion 11*a* and gaps between the core wire portion 11*a* and the outer skin 11*b*.

In other words, the waterproof block 13 is configured by coating the first end portion 11*e* of the wire 11, which is coupled to the terminal fitting 12, with the water sealant resin to seal out water. Further, in order to cause uncured water sealant resin to permeate into gaps between the element wires of the core wire portion 11*a* and gaps between the core wire portion 11*a* and the outer skin 11*b*, negative-pressure suctioning may be performed inside the wire 11 coupled to the terminal fitting to generate a pressure differential inside and outside the wire 11, for example.

The water sealant of the waterproof block 13 is called a hot melt (registered trademark) type adhesive resin, and may be a moisture-curable silicone resin type, for example. Through heat application, shaping, and curing, the water sealant may exhibit adhesiveness with respect to the outer skin 11*b* of the wire 11, the element wires of the core wire portion 11*a*, the terminal fitting 12, and the like and exhibit rubber elasticity to such an extent that the water sealant has a relatively greater hardness than the outer skin 11*b* of the wire 11.

In addition, the waterproof block 13 includes a waterproof portion 31 covering the coupling portion 14 that couples the terminal fitting 12 and the first end portion 11*e* of the wire 11, the waterproof portion 31 also adhering to an outer circumferential surface of the end of the outer skin 11*b*; and a cylindrical portion 32 projecting cylindrically from the waterproof portion 31 along the outer skin 11*b* of the wire 11.

The waterproof portion 31 includes a large-diameter portion 31*c* surrounding the coupling portion 14 that couples the wire 11 and the terminal fitting 12 near the center of the waterproof block 13, particularly in the vicinity of the insulating resin barrel portion 12*d*; and a small-diameter portion 31*d* surrounding only the vicinity of the stepped bending portion 12*e* of the terminal fitting 12.

In addition, the waterproof portion 31 reaches maximum width in plate width and plate thickness directions of the fitting terminal 12 at the large-diameter portion 31*c*, and reaches minimum width in the plate width and plate thickness directions of the fitting terminal 12 at the small-diameter portion 31*d*.

The cylindrical portion 32 surrounding only the outer circumferential surface 11*d* adjacent to the end of the outer skin 11*b* of the wire 11 is smaller in diameter and thinner with respect to the large-diameter portion 31*c* of the waterproof portion 31. The end-adjacent outer circumferential surface 11*d* in this example is an outer circumferential surface of a predetermined width (axis direction length) which is adjacent to the outer circumferential surface 11*c* at the end of the outer skin 11*b*.

In other portions, the waterproof portion 31 is formed, generally, to have a substantially constant water sealant resin layer thickness with respect to an outer shape of the coupling portion 14 coupling the terminal fitting 12 and the first end portion 11*e* of the wire 11. Therefore, the shape of the outer circumferential surface 31*a* of the waterproof portion 31 is formed in a stepped shape between the large-diameter portion 31*c* and the small-diameter portion 31*d*, in the same direction as the outer shape of the coupling portion 14.

The cylindrical portion 32 has a smaller cross sectional area than the large-diameter portion 31*c* of the waterproof portion 31 in a cross sectional direction of the wire 11, and has rigidity more similar to the outer skin 11*b* of the wire 11 than the waterproof portion 31 in desired bending and torsional directions of the wire 11. In addition, an inner circumferential surface 32*a* of the cylindrical portion 32 is tightly adhered to the end-adjacent outer circumferential surface 11*d* of the outer skin 11*b* of the wire 11 and is bonded to the end-adjacent outer circumferential surface 11*d*.

Further, an outer circumferential surface 32*b* of the cylindrical portion 32 includes a stepped contracted portion 33 positioned toward an inner side (the side close to the inner circumferential surface 32*a*) around the whole circumference with respect to an imaginary truncated conical surface 13*fc* which extends from an edge 31*f* of the outer circumferential surface 31*a* of the waterproof portion 31 on the base end of the cylindrical portion 32 to an edge 32*f* of the outer circumferential surface 32*b* of the cylindrical portion 32 on the forefront end of the cylindrical portion 32.

"The stepped contraction" in this example means that a first end portion of the cylindrical portion 32, which forms a transition portion from the outer circumferential surface 31*a* of the waterproof portion 31 to the outer circumferential surface 32*b* of the cylindrical portion 32, is contracted in a stepped shape.

In the present embodiment, the outer circumferential surface 32*b* of the cylindrical portion 32 forms, on a first side of the stepped contracted portion 33 (on left side in FIG. 1), a first tapered surface 32*c* having a substantially rectangular pyramid shape which becomes smaller in diameter the farther the first tapered surface 32*c* is separated from the edge 31*f* of the outer circumferential surface 31*a* of the waterproof portion 31, and on a second side of the stepped contracted portion 33 (on right side in FIG. 1), a second tapered surface 32*d* inclined by an inclination angle θ2 which is smaller than an inclination θ1 of the first tapered surface 32*c* in the same direction.

Figure 3A:
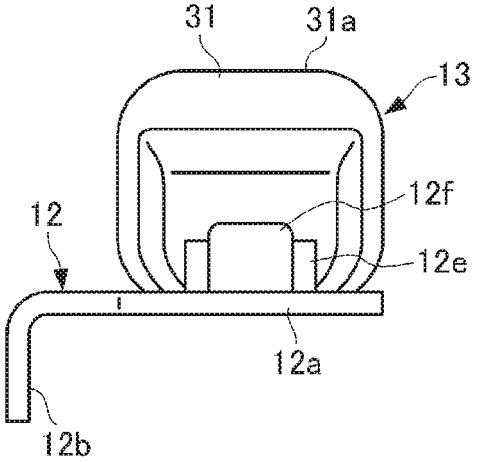
FIG. 3A is a left side view, observed from a left side of FIG. 1, of Embodiment 1 of the waterproof structure for the terminal of the wire with the terminal fitting according to the present invention.
Figure 3B:
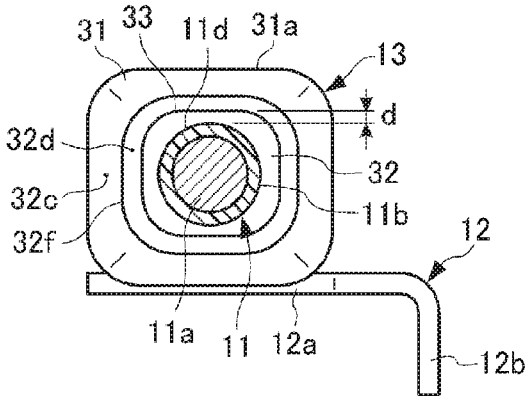
FIG. 3B is a right side view, observed from a right side of FIG. 1, of Embodiment 1 of the waterproof structure for the terminal of the wire with the terminal fitting according to the present invention.

The radius of the outer circumferential surface 32*b* at the edge 32*f* of the outer circumferential surface 32*b* of the cylindrical portion 32 is larger than the radius of the outer skin 11*b* of the wire 11 by a predetermined minimum layer thickness d (see FIG. 3B).

Next, an operation of the present invention is described.

In the wire with the terminal fitting 10 according to the present embodiment configured as described above, the cylindrical portion 32 of the waterproof block 13 includes the outer circumferential surface 32*b*, which is not simply a tapered shape along the imaginary truncated conical surface 13*fc*, but is positioned further toward the inner side than the imaginary truncated conical surface 13*fc*.

Therefore, the cylindrical portion 32 of the waterproof block 13 has low rigidity in the bending and torsional directions of the wire 11 with respect to the waterproof portion 31 and readily follows the outer skin 11*b*. The deformation and stress of the outer skin 11*b* caused by the bending and torsion of the wire 11 are effectively dispersed within a range of the adhesive surface between the outer skin 11*b* and the inner circumferential surface 32*a* of the cylindrical portion 32 without concentrating near the outer edge of the inner circumferential surface 32*a* of the cylindrical portion 32, in other words, at an inner circumferential edge 32*g* (see FIG. 1) of the end portion on the cylindrical portion 32 side of the waterproof block 13. In addition, because the flexibility of the cylindrical portion 32 (ability to follow the wire 11) increases, a layout surface of the wire harness including the wire with terminal fitting 10 is also advantageous.

Therefore, the outer skin 11*b* of the wire 11 becomes unlikely to peel off at the inner circumferential edge 32*g* of the end portion of the waterproof block 13 and the peeling becomes unlikely to advance to a deep interior side from the inner circumferential edge 32*g* of the end portion of the waterproof block 13. In addition, at the waterproof portion 31 side of the waterproof block 13 covering the coupling portion 14 that couples the terminal fitting 12 and the wire 11, a water sealant resin can be used that is capable of obtaining favorable waterproofing, wear resistance, weather resistance, and the like.

As a result, the waterproof structure for the terminal can ensure adhesion between and the ability of the cylindrical portion 32, which is the wire side end portion of the waterproof block 13, to follow the wire 11, and can ensure a stable waterproofing performance of the waterproof portion 31, which covers the coupling portion 14 coupling the terminal fitting 12 and the wire 11 and seals out water. Further, grounding can be performed inside the engine compartment of the vehicle, and therefore, compared to the conventional case when the wire is pulled toward the vehicle interior to perform grounding, the length of the wire with terminal fitting 10 (ground wire) can be shortened significantly and the cost and weight of the wire harness which uses the wire with terminal fitting 10 can be reduced.

Furthermore, in the present embodiment, the outer circumferential surface 32*b* of the cylindrical portion 32 has the stepped contracted portion 33 positioned toward the inner side around the whole circumference relative to the imaginary truncated conical surface 13*fc*. Therefore, by appropriately selecting the axis direction position of the stepped contracted portion 33 on the cylindrical portion 32, the rigidity against the bending and torsion of the cylindrical portion 32 can be properly reduced at a favorable position closer to the base end side of the cylindrical portion 32 than the inner circumferential edge 32*g* of the end of the cylindrical portion 32. Accordingly, peeling away from the outer skin 11*b* of the wire 11 at the inner circumferential edge 32*g* of the end of the cylindrical portion 32 is effectively suppressed and the progress of the peeling toward the waterproof portion 31 from the cylindrical portion 32 side of the waterproof block 13 can be more effectively suppressed, and therefore, the adhesion between and the ability of the cylindrical portion 32 to follow the wire 11 can favorably obtained.

Accordingly, the present embodiment can provide the waterproof structure for the terminal of the wire with the terminal fitting capable of ensuring the adhesion between and the ability of the cylindrical portion 32, which is the wire side end portion of the waterproof block 13, to follow the wire 11, and capable of ensuring the stable waterproofing performance of the waterproof portion 31, which covers the coupling portion 14 coupling the terminal fitting 12 and the wire 11 and seals out water.

Embodiment 2

FIGS. 5A, 5B, 6A, and 6B illustrate Embodiment 2 of a waterproof structure for a terminal of a wire with a terminal fitting according to the present invention.

In each of the embodiments described below, the overall schematic configuration is similar to that of Embodiment 1 described above. Only the shape of the cylindrical portion projecting from the waterproof portion 31 of the waterproof block 13 toward the wire 11 is different from the cylindrical portion 32 in Embodiment 1. Therefore, in the descriptions of each embodiment below, reference numerals for structural elements corresponding to those shown in FIGS. 1 to 4 are used for configurations similar to those of Embodiment 1 and only the differences are described.

As shown in FIGS. 5A, 5B, 6A, and 6B, in Embodiment 2, an outer circumferential surface 42*b* of a cylindrical portion 42 projecting from the first end of the waterproof portion 31 of the waterproof block 13 has a stepped contracted portion 43 positioned toward the inner side around the whole circumference relative to the truncated conical surface 13*fc*.

The outer circumferential surface 42*b* of the cylindrical portion 42 is contracted in the stepped shape at the first end portion of the cylindrical portion 42 which forms the transition portion from the outer circumferential surface 31*a* of the waterproof portion 31 to the outer circumferential surface 42*b* of the cylindrical portion 42.

Accordingly, on a first side of the stepped contracted portion 43 (left side in FIGS. 5A and 5B), a tapered outer circumferential surface 42*c* is formed in the substantially rectangular pyramid shape which becomes smaller in diameter the farther the tapered outer circumferential surface 42*c* is separated from the edge 31*f* of the outer circumferential surface 31*a* of the waterproof portion 31. On the second side of the stepped contracted portion 33 (right side in FIGS. 5A and 5B) is formed a straight outer circumferential surface 42*d*, which is formed cylindrically in parallel to the end-adjacent outer circumferential surface 11*d* of the outer skin 11*b* of the wire 11.

In addition, the radius of the straight outer circumferential surface 42*d* at an edge 42*f* of the outer circumferential surface 42*b* of the cylindrical portion 42 is larger than the radius of the outer skin 11*b* of the wire 11 by the predetermined minimum layer thickness d.

The inner circumferential surface 42*a* of the cylindrical portion 42 is formed to have the cylindrical surface shape which is identical to the inner circumferential surface 32*a* of the cylindrical portion 32 in Embodiment 1.

The present embodiment, similar to Embodiment 1, can provide the waterproof structure for the terminal of the wire with the terminal fitting capable of ensuring the adhesion between and ability of the cylindrical portion 42, which is the wire side end portion of the waterproof block 13, to follow the wire 11, and capable of ensuring the stable waterproofing performance of the waterproof portion 31, which covers the coupling portion 14 coupling the terminal fitting 12 and the wire 11 and seals out water.

Embodiment 3

Figure 7A:
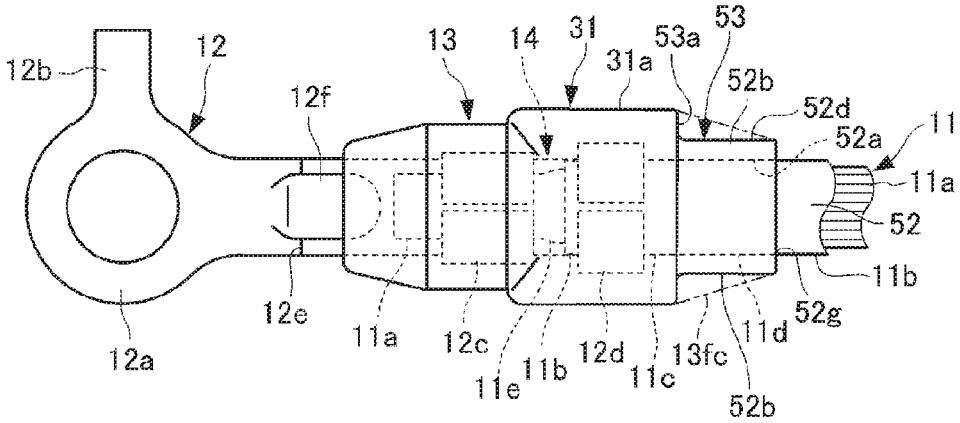
FIG. 7A is a plan view of a main portion illustrating Embodiment 3 of a waterproof structure for a terminal of a wire with a terminal fitting according to the present invention.
Figure 7B:
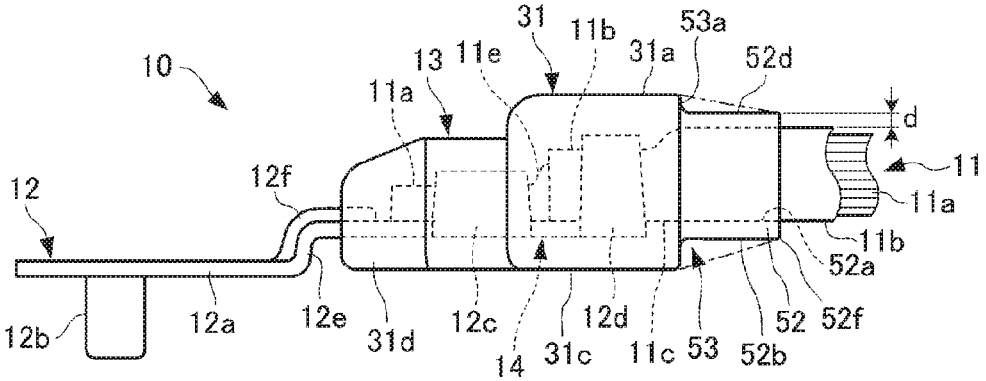
FIG. 7B is a front view of the main portion illustrating Embodiment 3 of the waterproof structure for the terminal of the wire with the terminal fitting according to the present invention.
Figure 8A:
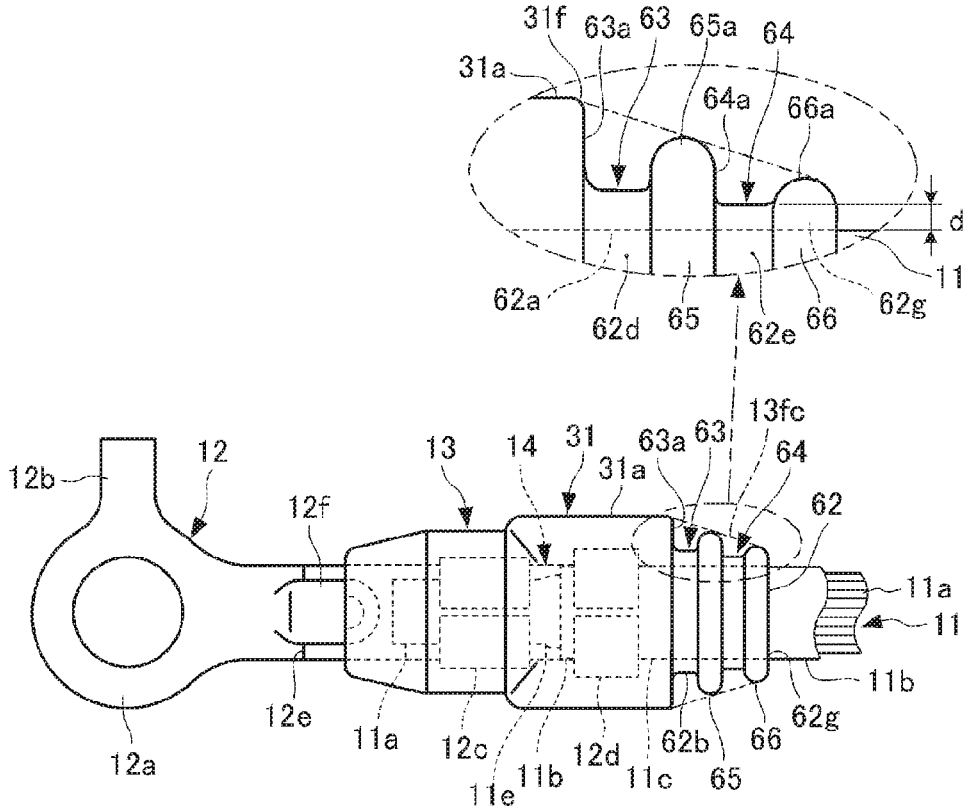
FIG. 8A is a plan view of the main portion illustrating Embodiment 4 of a waterproof structure for a terminal of a wire with a terminal fitting according to the present invention.
Figure 8B:
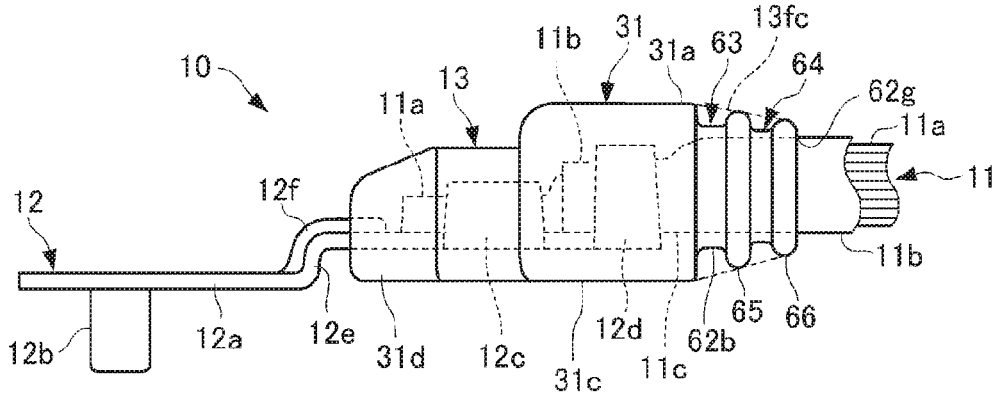
FIG. 8B is a front view of the main portion illustrating Embodiment 4 of the waterproof structure for the terminal of the wire with the terminal fitting according to the present invention
Figure 9A:
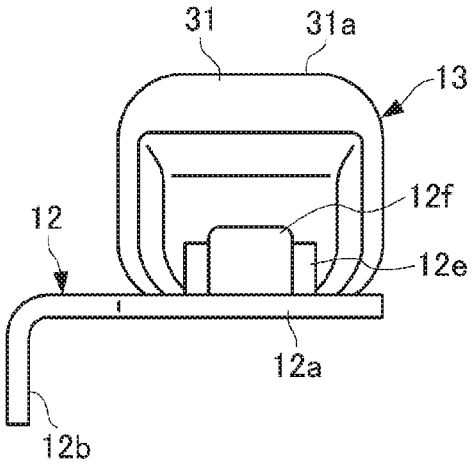
FIG. 9A is a left side view, observed from the left side of FIG. 8B, of Embodiment 4 of the waterproof structure for the terminal of the wire with the terminal fitting according to the present invention.
Figure 9B:
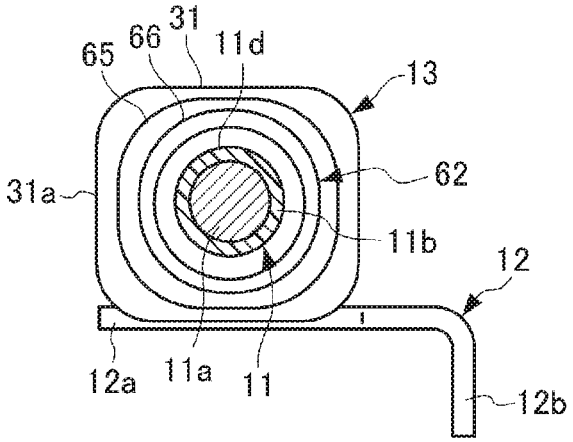
FIG. 9B is a right side view, observed from the right side of FIG. 8B, of Embodiment 4 of the waterproof structure for the terminal of the wire with the terminal fitting according to the present invention.

FIGS. 7A and 7B illustrate Embodiment 3 of a waterproof structure for a terminal of a wire with a terminal fitting according to the present invention.

As shown in FIGS. 7A and 7B, in Embodiment 3, an outer circumferential surface 52*b* of a cylindrical portion 52 projecting from the first end of the waterproof portion 31 of the waterproof block 13 has a stepped contracted portion 53 positioned toward the inner side around the whole circumference relative to the truncated conical surface 13*fc*.

The outer circumferential surface 52*b* of the cylindrical portion 52 is contracted in the stepped shape at the first end portion of the cylindrical portion 52 which forms the transition portion from the outer circumferential surface 31*a* of the waterproof portion 31 to the outer circumferential surface 52*b* of the cylindrical portion 52.

Accordingly, on the first side of the stepped contracted portion 53 (left side in FIGS. 7A and 7B), the stepped contracted portion 53 is formed contracting while forming a stepped surface 53*a* that is substantially perpendicular to the edge 31*f* of the outer circumferential surface 31*a* of the waterproof portion 31. On the second side of the stepped contracted portion 53 (right side in FIGS. 7A and 7B), a straight outer circumferential surface 52*d* is formed which has a cylindrical shape parallel to the end-adjacent outer circumferential surface 11*d* of the outer skin 11*b* of the wire 11.

In addition, the radius of the straight outer circumferential surface 52*d* at an edge 52*f* of the outer circumferential surface 52*b* of the cylindrical portion 52 is larger than the radius of the outer skin 11*b* of the wire by the predetermined minimum layer thickness d.

The inner circumferential surface 52*a* of the cylindrical portion 52 is formed to have the cylindrical surface shape which is identical to the inner circumferential surface 32*a* of the cylindrical portion 32 in Embodiment 1.

The present embodiment, similar to Embodiment 1, can provide the waterproof structure for the terminal of the wire with the terminal fitting capable of ensuring the adhesion between and ability of the cylindrical portion 52, which is the wire side end portion of the waterproof block 13, to follow the wire 11, and capable of ensuring the stable waterproofing performance of the waterproof portion 31, which covers the coupling portion 14 coupling the terminal fitting 12 and the wire 11 and seals out water.

Embodiment 4

FIGS. 8A, 8B, 9A, and 9B illustrate Embodiment 4 of a waterproof structure for a terminal of a wire with a terminal fitting according to the present invention.

As shown in FIGS. 8A, 8B, 9A, and 9B, in Embodiment 4, an outer circumferential surface 62*b* of a cylindrical portion 62 projecting from the first end of the waterproof portion 31 of the waterproof block 13 has a first stepped contracted portion 63 positioned toward the inner side around the whole circumference relative to the truncated conical surface 13*fc* and a second stepped contracted portion 64 positioned further toward a forefront end of the cylindrical portion 62 than the first stepped contracted portion 63.

The second stepped contracted portion 64 is smaller in diameter than the first stepped contracted portion 63 and is positioned at the inner side around the whole circumference with respect to the truncated conical surface 13*fc*.

In addition, the cylindrical portion 62 includes a first annular projection 65 and a second annular projection 66. The first annular projection 65 is substantially annular and is close to the truncated conical surface 13*fc* around the whole circumference while more proximate to the forefront end of the cylindrical portion 62 relative to the first stepped contracted portion 63. The second annular projection 66 is close to the truncated conical surface 13*fc* around the whole circumference between the first annular projection 65 and the second stepped contracted portion 64.

The second annular projection 66 is smaller in diameter than the first annular projection 65 since the second annular projection 66 is close to the truncated conical surface 13*fc* around the whole circumference while positioned further toward the forefront end of the cylindrical portion 62 than the first annular projection 65.

Accordingly, in the present embodiment, the cylindrical portion 62 is contracted in the stepped shape by the first stepped contracted portion 63 at the first end portion of the cylindrical portion 62 which forms the transition portion from the outer circumferential surface 31*a* of the waterproof portion 31 to the outer circumferential surface 62*b* of the cylindrical portion 62, and then the cylindrical portion 62 is enlarged to an extent that is close to the truncated conical surface 13*fc* at the first annular projection 65. When in transition to the second end side of the cylindrical portion 62, the cylindrical portion 62 is again contracted to a smaller diameter by forming another stepped shape with the second stepped contracted portion 64, then the cylindrical portion 62 is enlarged to the extent that the cylindrical portion 62 is close to the truncated conical surface 13*fc* at the second annular projection 66.

Accordingly, on the first side of the stepped contracted portion 63 (left side in FIGS. 8A and 8B), the first stepped contracted portion 63 is formed contracting while forming a stepped surface 63*a* that is substantially perpendicular to the edge 31*f* of the outer circumferential surface 31*a* of the waterproof portion 31. On the second side of the first stepped contracted portion 63 (right side in FIGS. 8A and 8B), a first straight outer circumferential surface 62*d* is formed which has a cylindrical portion parallel to the end-adjacent outer circumferential surface 11*d* of the outer skin 11*b* of the wire 11.

Further, on the first side of the second stepped contracted portion 64, the stepped surface 64*a* is formed contracting substantially perpendicular to the outer circumferential surface 65*a*, which is a substantially semicircular cross section of the first annular projection 65. On the second side of the second stepped contracted portion 64, a second straight outer circumferential surface 62*e* is formed which has a cylindrical portion parallel to the end-adjacent outer circumferential surface 11*d* of the outer skin 11*b* of the wire 11.

An outer circumferential surface 66*a* of the second annular projection 66 is substantially semicircular in cross section. In addition, the radius of the second straight outer circumferential surface 62*e* of the cylindrical portion 62 is larger than the radius of the outer skin 11*b* of the wire 11 by the predetermined minimum layer thickness d. Further, an inner circumferential surface 62*a* of the cylindrical portion 62 is formed to have the cylindrical surface shape which is identical to the inner circumferential surface 32*a* of the cylindrical portion 32 in Embodiment 1.

The present embodiment, similar to Embodiment 1, can also provide the waterproof structure for the terminal of the wire with the terminal fitting capable of ensuring the adhesion between and ability of the cylindrical portion 62, which is the wire side end portion of the waterproof block 13, to follow the wire 11, and capable of ensuring the stable waterproofing performance of the waterproof portion 31, which covers the coupling portion 14 coupling the terminal fitting 12 and the wire 11 and seals out water.

Further, in the present embodiment, the peeling of the adhesive surface between the inner circumferential surface 62*a* of the cylindrical portion 62 and the end-adjacent outer circumferential surface 11*d* of the outer skin 11*b* of the wire 11 is effectively suppressed by the first and second annular projections 65 and 66, which are shaped as a plurality of hoops, and multistage bending is allowed near the first and second stepped contracted portions 63 and 64, which form a plurality of thin-walled portions. Therefore, the peeling of the adhesive surface from the outer skin 11*b* of the wire 11 at an inner circumferential edge 62*g* at an end of the cylindrical portion 62 and the progress of the peeling toward the waterproof portion 31 of the waterproof block 13 from the cylindrical portion 62 side can be effectively suppressed and the adhesion between and ability of the cylindrical portion 62 to follow the wire 11 can be further improved.

Embodiment 5

Figure 10A:
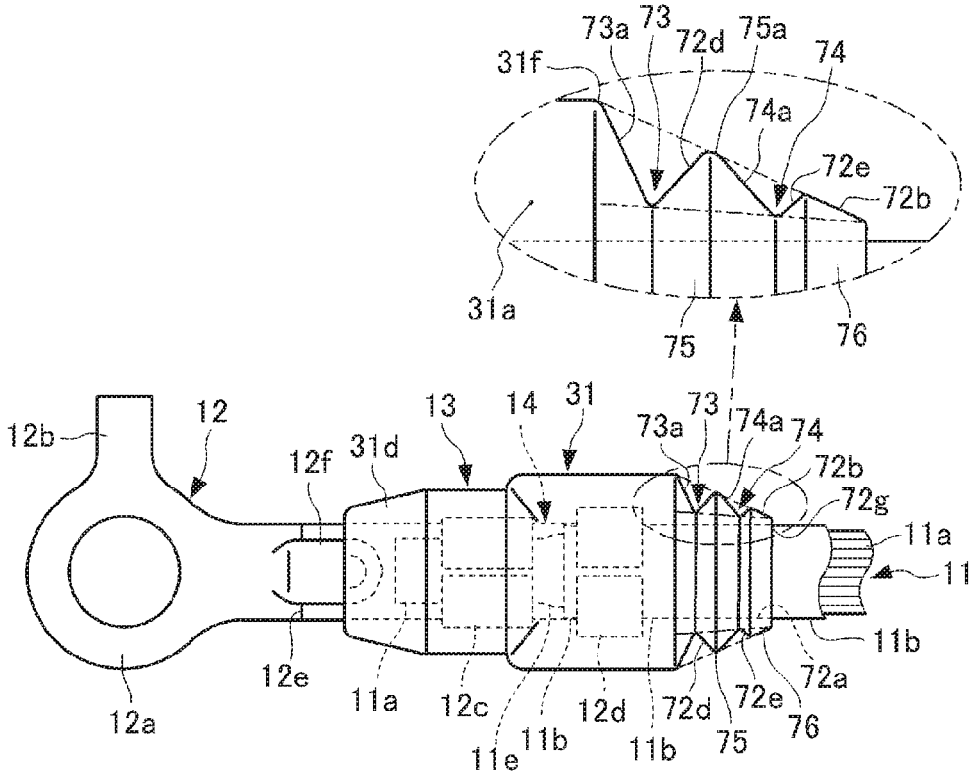
FIG. 10A is a plan view of a main portion illustrating Embodiment 5 of a waterproof structure for a terminal of a wire with a terminal fitting according to the present invention.
Figure 10B:
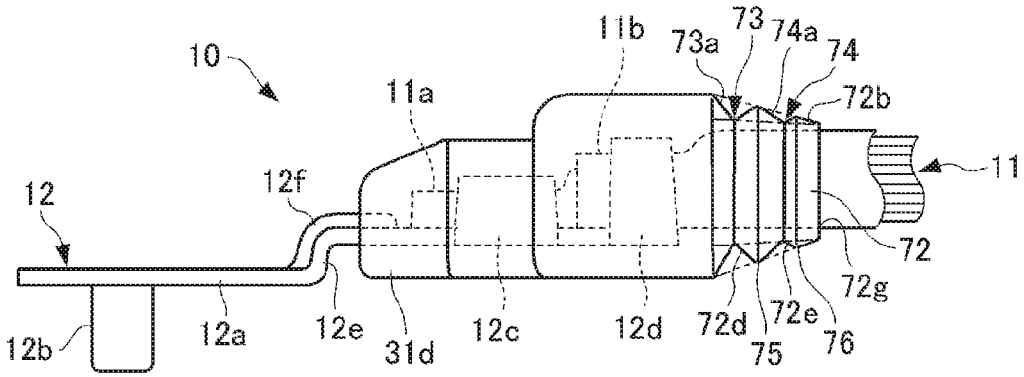
FIG. 10B is a front view of the main portion illustrating Embodiment 5 of the waterproof structure for the terminal of the wire with the terminal fitting according to the present invention.

FIGS. 10A and 10B illustrate Embodiment 5 of a waterproof structure for a terminal of a wire with a terminal fitting according to the present invention.

As shown in FIGS. 10A and 10B, in Embodiment 5, an outer circumferential surface 72*b* of a cylindrical portion 72 projecting from the first end of the waterproof portion 31 of the waterproof block 13 has a first stepped contracted portion 73 positioned toward the inner side around the whole circumference relative to the truncated conical surface 13*fc* and a second stepped contracted portion 74 positioned further toward the forefront end of the cylindrical portion 72 than the first stepped contracted portion 73.

The second stepped contracted portion 74 is smaller in diameter than the first stepped contracted portion 73 and is positioned toward the inner side around the whole circumference relative to the truncated conical surface 13*fc*.

In addition, the cylindrical portion 72 includes a first annular projection 75 and a second annular projection 76. The first annular projection 75 is substantially annular and is close to the truncated conical surface 13*fc* around the whole circumference while more proximate toward the forefront end of the cylindrical portion 72 than the first stepped contracted portion 73. The second annular projection 76 is close to the truncated conical surface 13*fc* around the whole circumference between the first annular projection 75 and the second stepped contracted portion 74.

The second annular projection 76 is smaller in diameter than the first annular projection 75 since the second annular projection 76 is close to the truncated conical surface 13*fc* around the whole circumference while positioned further toward the forefront end of the cylindrical portion 72 than the first annular projection 75.

In the present embodiment, the cylindrical portion 72 is contracted in the stepped shape by the first stepped contracted portion 73 at the first end portion of the cylindrical portion 72 which forms the transition portion from the outer circumferential surface 31*a* of the waterproof portion 31 to the outer circumferential surface 72*b* of the cylindrical portion 72, and then the cylindrical portion 72 is enlarged to an extent that is close to the truncated conical surface 13*fc* at the first annular projection 75. When in transition to the second end side of the cylindrical portion 72, the cylindrical portion 72 is again contracted to a smaller diameter by forming another stepped shape with the second stepped contracted portion 74, then the cylindrical portion 72 is enlarged to an extent that is close to the truncated conical surface 13*fc* at the second annular projection 76.

On the first side of the first stepped contracted portion 73 (left side in FIGS. 10A and 10B), the first stepped contracted portion 73 is formed contracting while forming a tapered stepped surface 73*a* which is inclined by a predetermined angle with respect to the end-adjacent outer circumferential surface 11*d* of the outer skin 11*b*, inclining from the edge 31*f* of the outer circumferential surface 31*a* of the waterproof portion 31. On the second side of the first stepped contracted portion 73 (right side in FIGS. 10A and 10B), a first reverse tapered outer circumferential surface 72*d* is formed which is inclined in a reverse direction from the stepped surface 73*a*, inclining by the predetermined angle with respect to the end-adjacent outer circumferential surface 11*d* of the outer skin 11*b* of the wire 11.

Further, on the first side of the second stepped contracted portion 74, a tapered stepped surface 74*a* is formed that is integral with the chevron-shaped in cross section outer circumferential surface 75*a* of the first annular projection 75. On the second side of the second stepped contracted portion 74, a second reverse tapered outer circumferential surface 72*e* is formed which is inclined in a reverse direction from the stepped surface 74*a*, inclining by the predetermined angle with respect to the end-adjacent outer circumferential surface 11*d* of the outer skin 11*b* of the wire 11.

The outer circumferential surface 76*a* of the second annular projection 76 has substantially a chevron shape in cross section. Further, the radius of the forefront end of the outer circumferential surface 72*b* of the cylindrical portion 72 is larger than the radius of the outer skin 11*b* of the wire 11 by the predetermined layer minimum thickness d. Furthermore, the inner circumferential surface 72*a* of the cylindrical portion 72 is formed to have the cylindrical surface shape which is identical to the inner circumferential surface 32*a* of the cylindrical portion 32 in Embodiment 1.

The present embodiment, similar to Embodiment 1, can also provide the waterproof structure for the terminal of the wire with the terminal fitting capable of ensuring the adhesion between and ability of the cylindrical portion 72, which is the wire side end portion of the waterproof block 13, to follow the wire 11, and capable of ensuring the stable waterproofing performance of the waterproof portion 31, which covers the coupling portion 14 coupling the terminal fitting 12 and the wire 11 and seals out water.

In addition, similar to Embodiment 4, the present embodiment allows the multistage bending and torsion of the cylindrical portion 72, and the peeling of the adhesive surface from the outer skin 11*b* of the wire 11 at an inner circumferential edge 72*g* of an end of the cylindrical portion 72 and the progress of the peeling toward the waterproof portion 31 of the waterproof block 13 from the cylindrical portion 72 side can be suppressed effectively and the adhesion between and ability of the cylindrical portion 72 to follow the wire 11 can be further improved.

In the above-described embodiments, the axis direction length of the cylindrical portion 32 is smaller than the waterproof portion 31 in the drawings, however, the axis direction length may be longer than the waterproof portion 31. In addition, a curvature radius of the outer circumferential surface at a valley portion of the stepped contracted portions 33, 43, 53, 63, 64, 73, and 74 may of course be set at any desired value. Furthermore, in each of Embodiments 4 and 5, two stepped contracted portions are provided, however, three or more stepped contracted portions may be provided. However, the main purpose of the waterproof block 13 is to stop water and the curvature radius of the wire 11 does not become excessively small due to the relatively high rigidity of the insulation coated wire. Therefore, while setting the minimum layer thickness d to be equal to or greater than the thickness of the outer skin 11*b* according to the thickness (diameter) and the cross sectional area of the wire 11, at least one stepped contracted portion per waterproof portion 31 may be provided further toward the base end of the cylindrical portion than it. Characteristics of the water sealant resin forming the waterproof block 13, and in particular hardness after curing, rubber elasticity, and the like, may of course be defined as appropriate based on the hardness, the thickness, and the like of the coating.

In addition, in each of the above-described embodiments, the terminal fitting 12 is crimp-coupled to the end portion 11*e* of the wire 11, however, electrical and mechanical coupling may of course be achieved by ultrasonic welding and the like. Of course, the terminal fitting 12 may also be a terminal fitting omitting the insulating resin barrel portion 12*d* and having an elongated wire barrel portion 12*c*.

Furthermore, each of the stepped contracted portions 33, 43, and 53, the first stepped contracted portions 63 and 73, and the second stepped contracted portions 64 and 74 in the above-described embodiments are positioned toward the inner side around the whole circumference relative to the truncated conical surface 13*fc*, however, it is not necessary to have the same radius around the whole circumference and a shape where a portion in the circumferential direction is close to the truncated conical surface 13*fc* may be used. In addition, the first annular projections 65 and 75 and the second annular projections 66 and 76 are also not required to have the same radius around the whole circumference and thus the radius may be smaller so as to be separated from the truncated conical surface 13*fc* at a portion in the circumferential direction. Furthermore, when there are a plurality of both the stepped contracted portions and annular projections, widths of those components in the wire length direction can be defined as desired and it is also possible to define the adjacent annular projections to come into contact with each other when the wire is curved.

As described above, the present invention can provide a waterproof structure for a terminal of a wire with a terminal fitting capable of ensuring the adhesion between and ability of the wire side end portion of the waterproof block to follow the wire, and capable of ensuring the stable waterproofing performance of the waterproof portion, which covers the coupling portion coupling the terminal fitting and the insulation coated wire and seals out water. The present invention is generally useful to a waterproof structure for a terminal of a wire with a terminal fitting having a waterproof block made of resin provided to a terminal portion where the terminal is mounted.

DESCRIPTION OF REFERENCE NUMERALS

10: Wire with terminal fitting
11: Wire (insulation coated wire)
11*a*: Core wire portion
11*b*: Outer skin (insulation resin)
11*c*: End outer circumferential surface
11*d*: End-adjacent outer circumferential surface (adjacent outer circumferential surface)
11*e*: End portion (end portion of insulation coated wire)
12: Terminal fitting
12*a*: Connection portion
12*c*: Wire barrel portion
12*d*: Insulating resin barrel portion
13: Waterproof block
13*fc*: Truncated conical surface
14: Coupling portion
31: Waterproof portion
31*a*: Outer circumferential surface
32, 42, 52, 62, 72: Cylindrical portion
32*a*, 42*a*, 52*a*, 62*a*, 72*a*: Inner circumferential surface
32*b*, 42*b*, 52*b*, 62*b*, 72*b*: Outer circumferential surface
32*g*, 42*g*, 52*g*, 62*g*, 72*g*: Inner circumferential edge
33, 43, 53: Stepped contracted portion
63, 73: First stepped contracted portion
64, 74: Second stepped contracted portion
65, 75: First annular projection
66, 76: Second annular projection
θ1, θ2: Inclination angle

The invention claimed is:

1. A waterproof structure for a terminal of a wire with a terminal fitting provided with a waterproof block made of resin, the waterproof block covering an end portion of an insulation coated wire coupled to a terminal fitting for electrical connection, wherein the terminal fitting comprises a disc-shaped connection portion, a first barrel portion coupling to a core wire portion of the insulation coated wire projected from an end portion of an outer skin of the insulation coated wire, a second barrel portion coupling to the end portion of the outer skin, and a bending portion positioned between the connection portion and the first barrel portion; and the waterproof block comprises a waterproof portion covering a coupling portion where the terminal fitting and the end portion of the insulation coated wire are coupled, the waterproof portion adhering to an outer circumferential surface of an end of the outer skin of the insulation coated wire; and a cylindrical portion projecting cylindrically from the waterproof portion along the outer skin of the insulation coated wire, and the waterproof portion comprises a small-diameter portion surrounding the end portion of the core wire portion and the first barrel portion, and a large-diameter portion surrounding the end portion of the outer skin and the second barrel portion; and the cylindrical portion has a smaller cross sectional area than the waterproof portion and has rigidity more similar to the outer skin than the waterproof portion in desired bending and torsional directions of the insulation coated wire, and is adhered to an adjacent outer circumferential surface which is adjacent to the outer circumferential surface of the end of the outer skin; and the cylindrical portion of the waterproof block has a relatively greater hardness than the outer skin.

2. The waterproof structure for the terminal of the wire with the terminal fitting according to claim 1, wherein a cross sectional area of the core wire portion of the insulation coated wire which is covered by the outer skin is at least 5 $mm^2$.

3. The waterproof structure for the terminal of the wire with the terminal fitting according to claim 1, wherein the waterproof portion is formed in a stepped shape between the large-diameter portion and the small-diameter portion, in the same direction as an outer shape of the coupling portion.

4. The waterproof structure for the terminal of the wire with the terminal fitting according to claim 1, wherein an outer circumferential surface of the cylindrical portion includes a stepped contracted portion positioned toward an inner side around a whole circumference relative to a truncated conical surface which extends from an edge of an outer circumferential surface of the waterproof portion on a base end of the cylindrical portion to an edge of the outer circumferential surface of the cylindrical portion at a forefront end of the cylindrical portion.

5. The waterproof structure for the terminal of the wire with the terminal fitting according to claim 4, wherein the outer circumferential surface of the cylindrical portion includes a first stepped contracted portion positioned toward the inner side relative to the truncated conical surface, and a second stepped contracted portion positioned further toward the forefront end of the cylindrical portion then the first stepped contracted portion.

* * * * *